United States Patent [19]

Matalia

[11] 4,009,841

[45] Mar. 1, 1977

[54] MANUAL FLYING PASTER

[75] Inventor: Harshad D. Matalia, Easton, Pa.

[73] Assignee: American Newspaper Publishers Association, Inc., Easton, Pa.

[22] Filed: Oct. 6, 1975

[21] Appl. No.: 620,663

[52] U.S. Cl. ..... 242/58.3; 83/651.1; 83/307.1

[51] Int. Cl.[2] ..... B65H 19/10; B65H 19/20

[58] Field of Search ..... 242/58.1, 58.2, 58.3, 242/58.4, 58.5; 83/651.1, 307.1, 307.2, 307.3; 156/502, 504, 505, 507

[56] References Cited

UNITED STATES PATENTS

| | | | |
|---|---|---|---|
| 1,544,557 | 7/1925 | Coldwell | 242/58.3 |
| 1,837,698 | 12/1931 | Ball | 242/58.3 |
| 1,904,536 | 4/1933 | Richter | 242/58.3 |
| 2,656,602 | 10/1953 | Taylor | 83/651.1 |
| 3,195,827 | 7/1965 | Schowerer et al. | 242/58.3 X |
| 3,915,399 | 10/1975 | Kron et al. | 242/58.3 |

*Primary Examiner*—George F. Mautz
*Assistant Examiner*—John M. Jillions
*Attorney, Agent, or Firm*—David H. Semmes

[57] ABSTRACT

A manual flying paster for an efficient inexpensive manner of manually splicing a sequence of three rolls of newsprint as one continuous feed to small printing presses. The paster includes a pivotable cradle which can be directly mounted upon the existing rollstand frame of such small presses to allow a first expiring horizontal rear newsprint roll to be spliced onto a full forward newsprint roll, and then a new rear newsprint roll to be spliced onto the second expiring front newsprint roll for a continuous operating sequence of three newsprint rolls.

2 Claims, 4 Drawing Figures

MANUAL FLYING PASTER

BACKGROUND OF THE INVENTION

1. Field of the Invention

Flying splices are commonly used on large newspaper presses. On large newspaper presses, the press itself is two stories high or more. The press is basically situated on a ground floor and beneath this floor are the rolls of paper that are being used. These rolls are often held on a tripod device and through a combined mechanical and electrical piece of equipment known as a flying paster, a new roll is attached to an unwinding roll as it approaches the core.

These large machines are automatic or semi-automatic in nature and are quite expensive.

However, in the smaller presses, such as those commonly marketed as the Goss Urbanite or Harris V15-A, both the paper rolls and the press are located at one level. When it is necessary to change an expiring roll, the press is normally stopped and the leading edge of the new roll is glued to the web that is running through the press. This older web is then cut and is slowly worked through the press carrying the edge of the new roll with it. When the two glued edges pass safetly through the folder, the press is once again brought up to speed and the run continues.

2. Summary of the Prior Art

Exemplary of patented continuous newsprint roll feeding devices for such large presses are the following U.S. Pat. Nos.: TOKUNO 3,780,960; MOSELEY 3,775,223; SWANN 3,771,737; CRONIN 3,740,312; McDONALD 3,740,296; TAKIMOTO 3,654,035; HELM 3,645.463; PATO 3,637,155; DEGUTIS 3,309,035.

Unlike these automatic and semi-automatic devices the *Manual Flying Paster* taught herein is a simple manual device which can be easily mounted on smaller presses, such as the Goss Urbanite or Harris V15-A, without major modification. With the *Manual Flying Paster* three paper rolls may be continuously fed without stopping the press. For small press operations being able to have a sequence of three rolls fed continuously for one press stoppage represents a substantial improvement over previous operations.

The above-noted patents illustrate complex splicers which are simply not economically feasible for such small press operations and, unlike the manual flying paster, are not disclosed to be adaptable for mounting to the existing frame of the press itself.

Tokuno illustrates a web splicing device which employs a separate articulated motorized drive system. The web is first compressed between rollers and then speed synchronized on expiration to match the feed of a new roll, with pressure rollers on a separate frame member to effect the splice. The device of Tokuno is exemplary of large automatic splicers which are neither feasible nor adaptable to the peculiar requirements of smaller presses.

Moseley illustrates a conventional type of rotating web cradle with a belt drive to accelerate a full roll prior to contact with the expiring web through pressure roller. The large rotating cradle itself requires a motor and is typical of prior art rotating splices which are too large for smaller press operations. The patented device of Swann employs an accelerating mechanism and a frame entirely separate and independent of any existing press.

Cronin illustrates a threading device using a continuous belt to urge a new web into contact with a threading assembly including a perforate pressure member. The pivoting roll of Cronin is used for threading and does not function as a flying paster.

McDonald is another typical self-contained splicing roll stand requiring an acceleration mechanism and vertically movable pasting and cut-off mechanisms. McDonald again employs a separate frame and articulated motor-driven assemblies.

Takimoto's press feeding device alo employs a separate rotatable newsprint stand with a triple-shafted turret. This self-contained apparatus employs a series of three drums in order to compress and butt-splice a trailing web onto a full roll. Unlike the *Manual Flying Paster* herein disclosed, such automatic apparatus are not economically feasible for small presses and are not disclosed for use by modification directly on these existing presses.

Helms illustrates a web splicing apparatus with a festooner arrangement for maintaining the web stationary during a splicing operation.

The splicing operation of Pato uses articulated hydraulic pistons to sequentially position rolls between a horizontal and a vertical position. His sequence of operation, shown at FIGS. 5–13, employs an external frame with hydraulic actuating members and is without particularization to the manner of cutting off the expiring tail. While Pato includes a pivoting pressure arm, the paper rolls themselves are disclosed to be sequentially lifted and rotated by the articulated support arms.

Finally, the splicer of Degutis illustrates a triple shafted turret assembly for sequentially rotating full paper rolls against a contact roller during splicing. Such turret paper feeds are conventional for large scale printing press operations, however, the present invention is an accessory for mounting directly upon small printing presses, and it is for such small presses that the *Manual Flying Paster* has its utility.

In summary, the prior art illustrates various known splicing apparatus for continuous and automatic feeding of webs for large scale operations. However, there is not found a manual device efficiently allowing an intermittent feed of three rolls for smaller presses so that three rolls may be spliced before the press is shut down.

SUMMARY OF THE INVENTION

The improvement of a manual flying paster for small presses includes a pivotable cradle frame having a pair of opposed rollers. The cradle itself is conveniently and easily mounted adjacent an existing feed roller on such small presses as the Goss Urbanite. The forward paster roller includes a cutter mechanism operable to cut the tail off both the first expiring rear paper roll and then the second expiring front paper roll during the sequence of continuous feeding. In operation, a front roll is positioned, with an adhesive splice pattern, together with an initially feeding rear roll. After the initial rear roll has expired a second rear roll is positioned with a counterrotating splice pattern for splicing with the front roll after its expiration. Each new roll is spliced simply by pivoting the flying paster to effect a frictional engagement between the expiring web and the new roll. With the selective engagement of the forward and rear roller assemblies of the flying paster three paper rolls can thereby be continuously fed within one continuous operating sequence.

The web from either newsprint roll runs through two rubber rollers mounted on a cradle, such that by swinging the cradle an expiring web can be brought in contact with a new roll. By swinging the cradle and, hence, by pressing one of the rubber rollers against the new roll, the running web is pressed on the new roll. At slower speed, friction between two papers will speed up the new roll to the running speed of the web without a web break or excessive tension in the web. The leading end of the new roll is specially prepared by applying adhesive to it, and is positioned before splicing such that it will take about one revolution of the new roll before it comes in contact with the running web. This provides time for the new roll to come up to the web speed. Pressure of the rubber roller on the new roll will paste the adhesive end of the new roll to the running web and, hence, start the new roll. Proper selection and application of an adhesive will provide good bondage between the papers to withstand the tension. Once the pasting is done, the expiring web can be cut off and the full roll will continue the web.

Moreover, other features, objects and advantages of the improvement taught herein will become apparent by reference to the following detailed description and drawings.

DESCRIPTION OF THE PREFERRED EMBODIMENT

Figure 1:
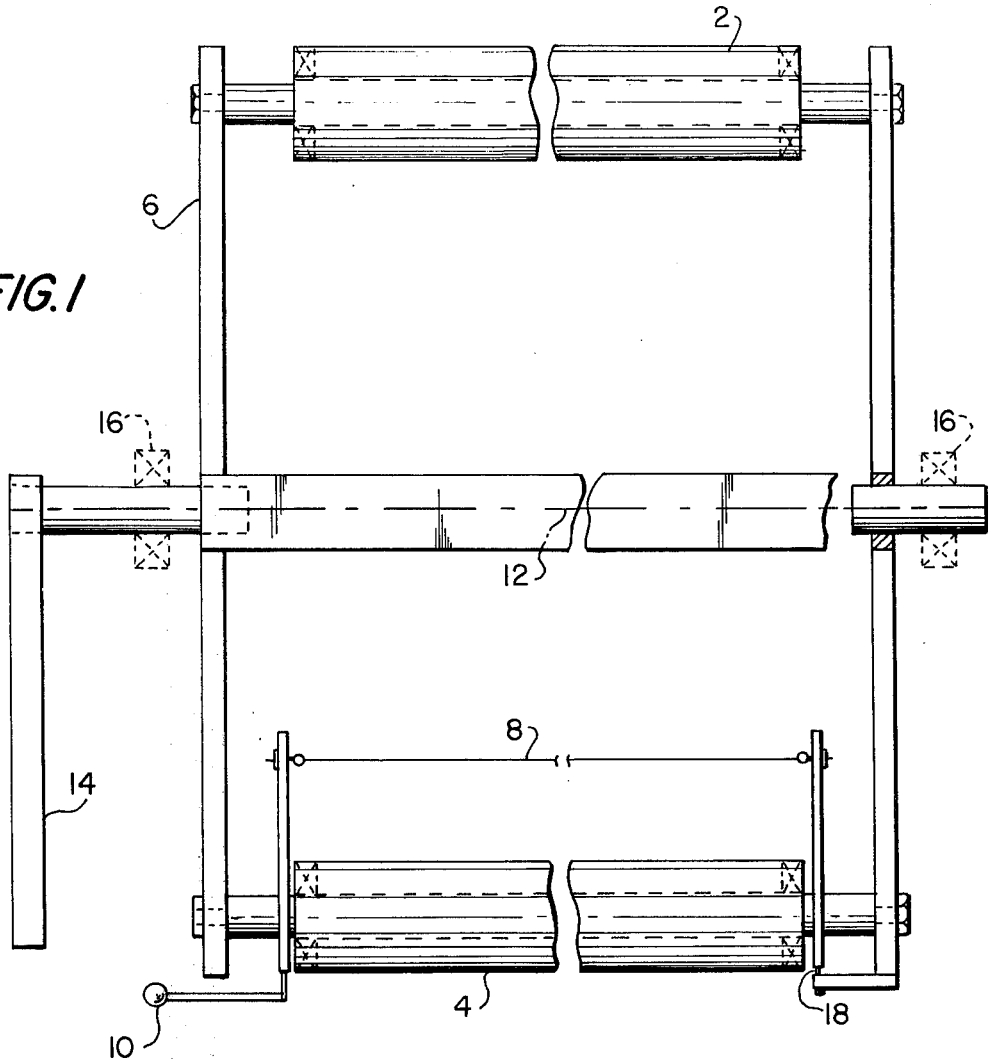
FIG. 1 schematically illustrates in top view the manual flying paster elements which may be mounted upon and within an existing small printing press.
Figure 2:
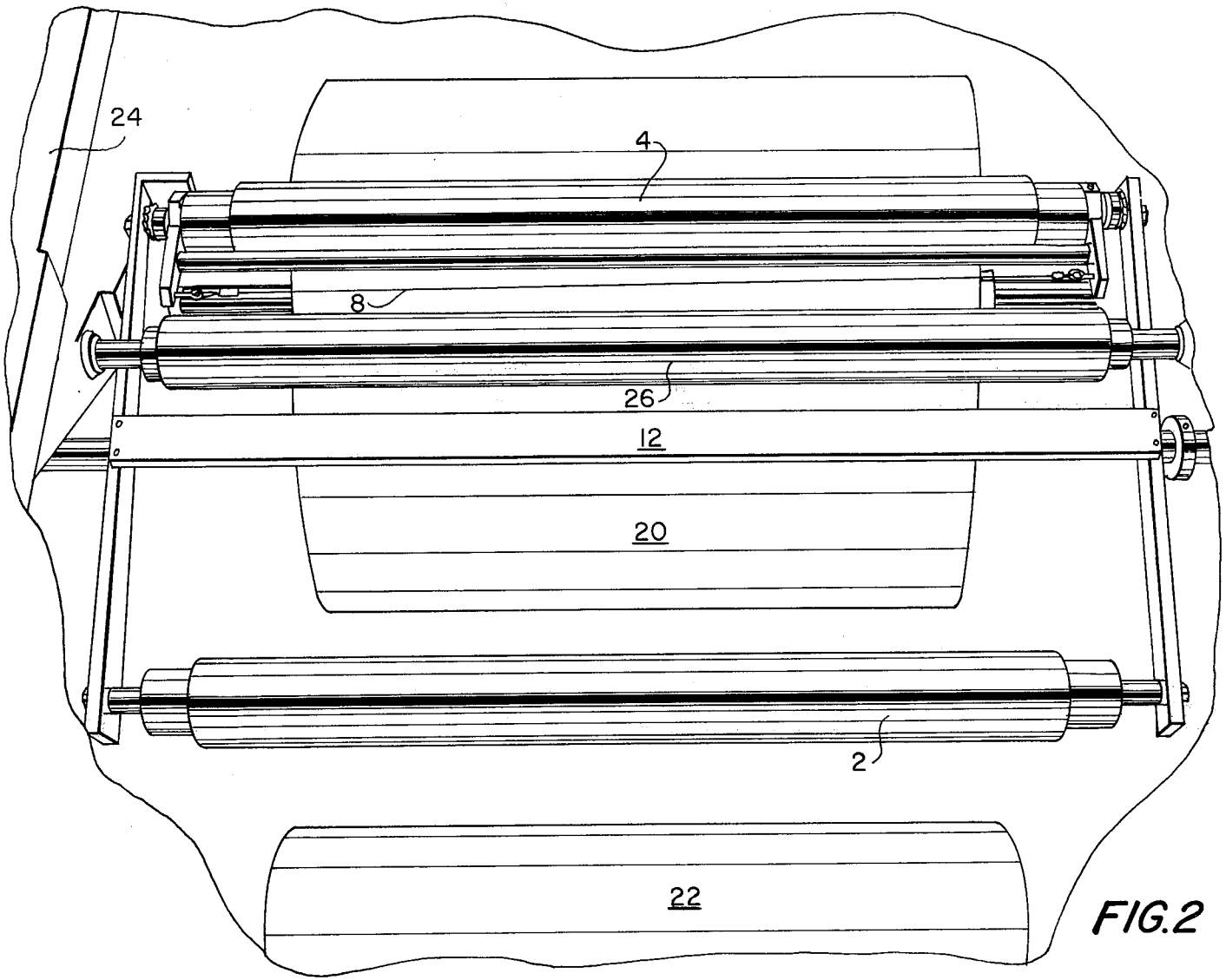
FIG. 2 illustrates the improvement in place on a small press.
Figure 3:
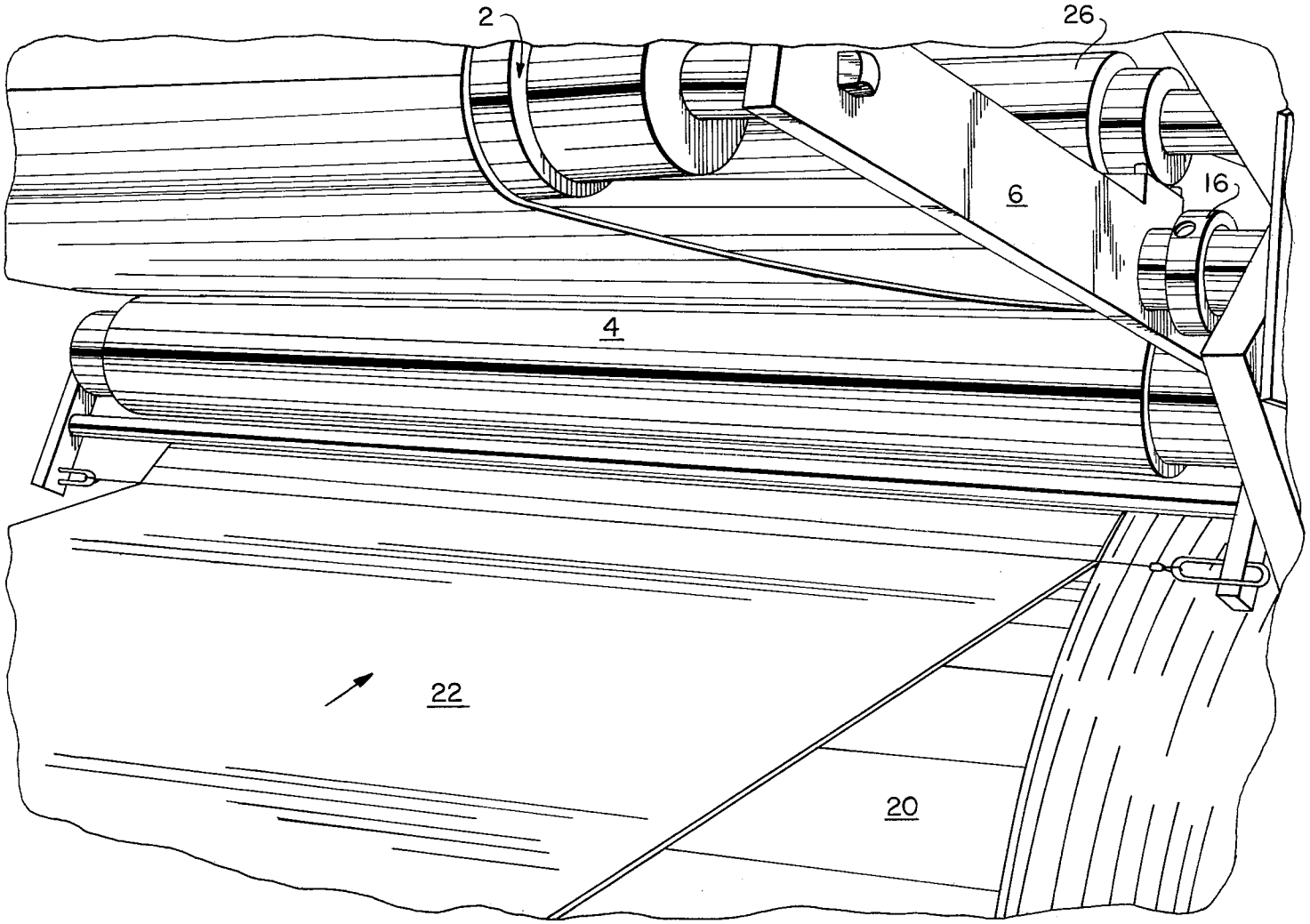
FIG. 3 illustrates the cut-off of a web from the first-expiring rear newsprint roll.

As shown in FIGS. 1 and 2, rear paster roller 2 and forward paster roller 4 are 3 inches dia., 38 inches, rubberized, free-running rollers with stationary shafts. Cradle frame 6 holds rollers 2 and 4. The shaft supporting paster roll 2 is bolted tight to the cradle frame while the shaft supporting roller 4 further includes cutter wire assembly 8 which is a cutter consisting of a thin, taut wire attached between two side brackets which are mounted to pivot on shaft of the forward paster roller assembly 4. An expiring web under tension is cut by rotating the cutter and pressing the wire against the web. The wire 8 is mounted skew to the rollers plane as shown in FIG. 2 so that it will first come into contact and cut an edge of the web, as illustrated in FIG. 3. The cradle is mounted at FIG. 2 on the roll stand frame 24 at a predetermined position above and between the forward and rear roll positions, 20 and 22 respectively, such that either of the rubber paster rollers can be brought in contact with its nearest full roll by swinging the cradle. Depending on the type of roll-stand on such small presses, suitable brackets or frames could be installed on press frame 24 at a position to hold the shafts of the cradle. Spherical bearings 16 could also be used to ease the alignment and installation of the cradle.

When the flying paster device is not in use, handle 14 may be pinned to the mounting bracket on frame 24 to hold it in a neutral position. This preferred embodiment of the manual flying paster is herein illustrated in use on a Goss Urbanite Offset Press. On this press mounting brackets fit into existing ¾ inch dia. holes in either of the frames of the rollstand. The cradle is thereby positioned so that it is below existing press roller 26 and high enough for a 40 inch dia. paper roll to be passed under the paster assembly to the forward paper roll position. Furthermore, during operation, motion of the cradle thereby does not interfere with full rolls at any position of the rollstand or the moving web. To accommodate this advantageous mounting feature, stubshafts are used instead of one straight shaft along the pivot axis 12 of the cradle. For rollstands on other than Goss presses, the dimensions of the paster component parts and mounting brackets may require some slight alterations to fit into the space between the paper roll positions.

Figure 4:
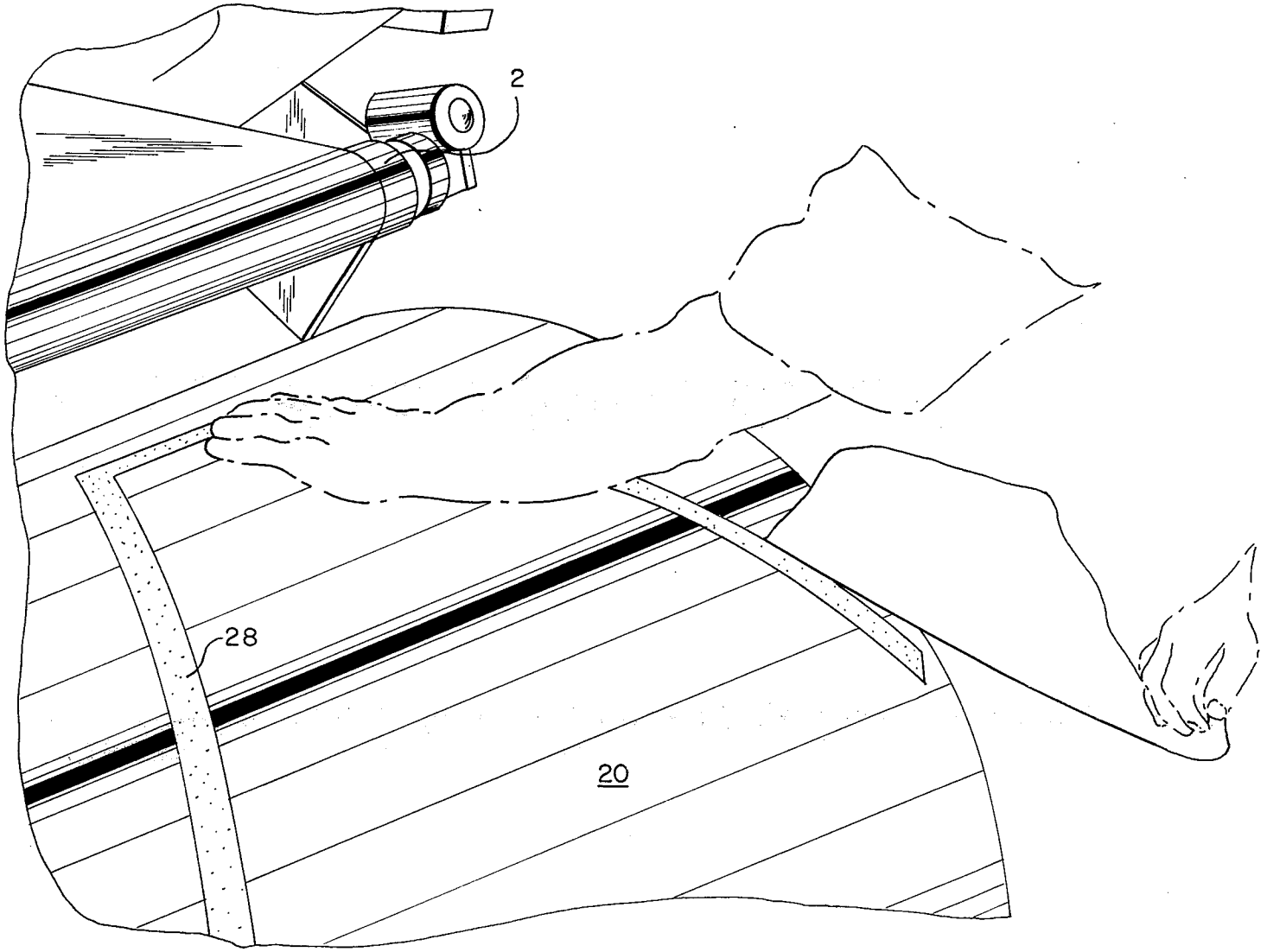
FIG. 4 shows the preparation of an adhesive splice pattern on the front newsprint roll before being moved into the forward paper roll position.
Figure 5:
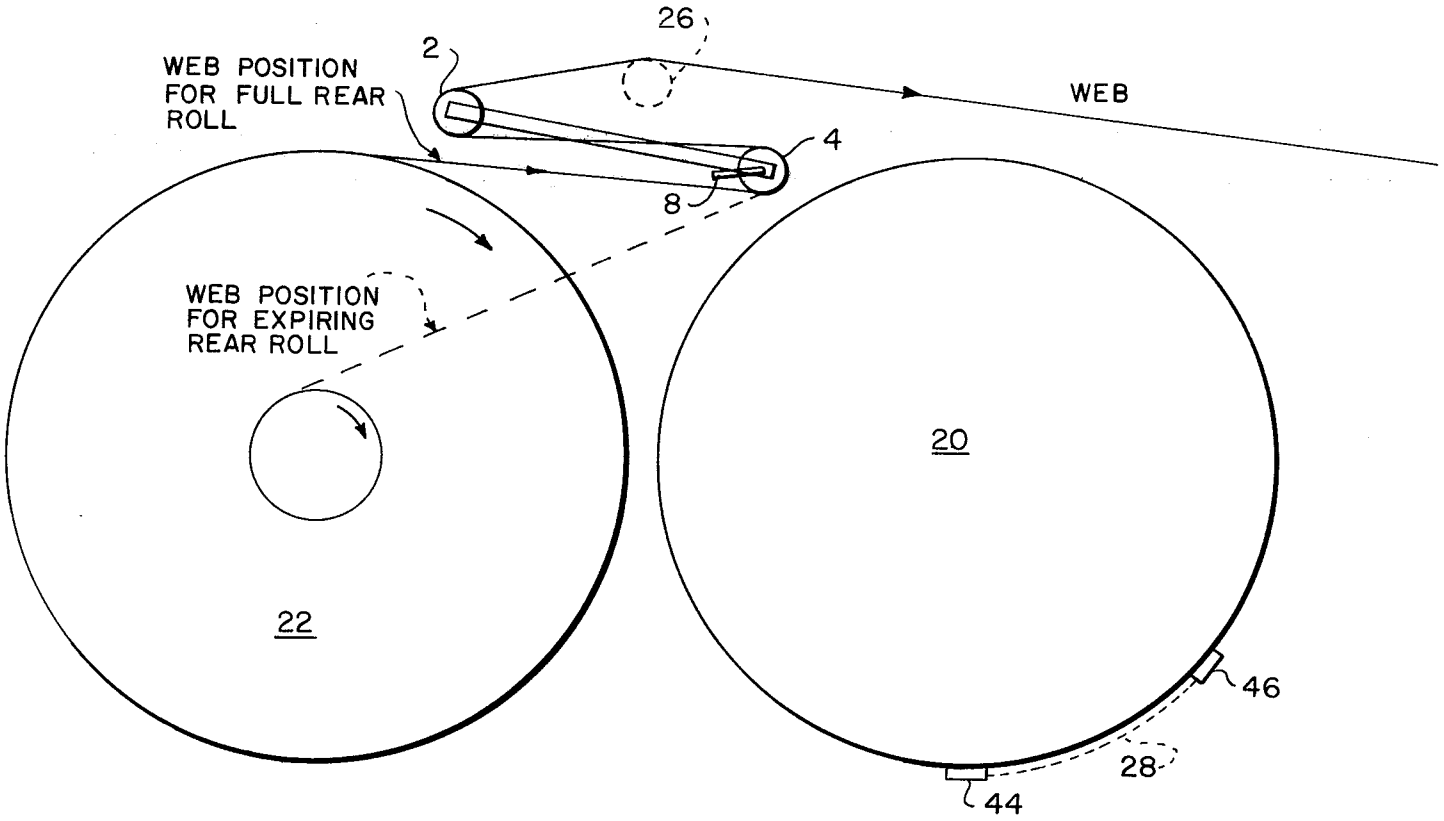
FIG. 5 schematically illustrates the initial and final web positions of the first expiring rear roll.
Figure 6:
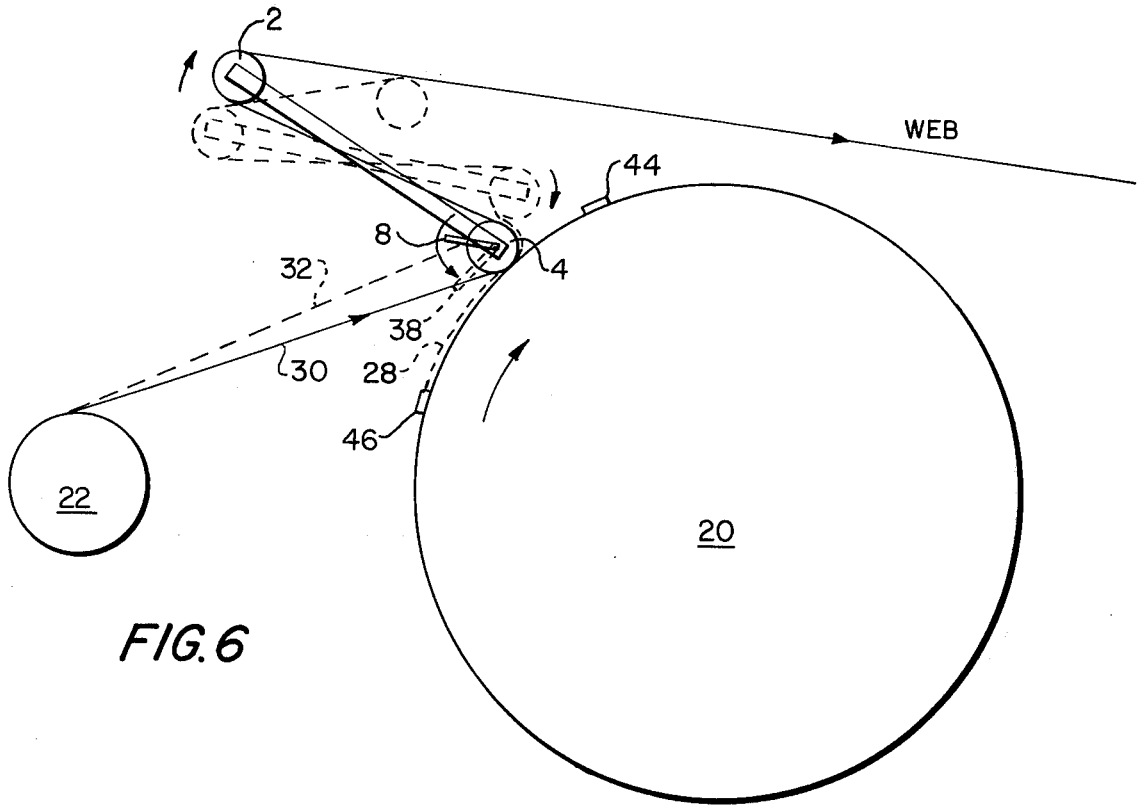
FIG. 6 schematically illustrates the first splicing operation.

Prior to beginning a press run, a full roll of newsprint is placed in the forward position of the roll stand, and, also prepared for pasting, such as with 3M brand No. 465 Adhesive Transfer Tape in the same manner as used in preparing a paper roll for a conventional automatic flying paster, and is shown in FIG. 4. When preparation is completed, the roll is rotated until the splice tab 44 is in the position shown at FIG. 5 and the brake is applied to hold the roll in this position. A second roll, 22, either full or partially used, is put in the rear position of the rollstand and is threaded around the paster and into the press, as shown at FIG. 5. When the rear positioned, and initially expiring, roll of paper is down to about ¼ inch from the core, the web is at 32 in FIG. 6, press speed is reduced (e.g. to 10,000 pph), brake tension on the roll to be spliced (forward roll 20) is loosened, with the leading end of the forward roll adhesive 44 being just pass the forward paster roller 4. Then the paster cradle 6 is rotated clockwise till the roller 4, with web around it, comes in firm contact with the new forward paper roll 20. Friction between expiring web position 30 and new roll will speed the new roll up to the press speed before the lead end with the adhesive comes in contact with the expiring web. A firm pressure of roller 4 on the circumference of paper roll 20 should be maintained during this time by handle 14. As the original paste pattern position 28, on the new roll comes under the expiring web a splice will be made under the pressure of the rubber roller 4, as shown in FIG. 6. As soon as the total pasting is made, the paster handle 14 is brought back to its neutral position and locked, and the cutter handle 10 is rotated downwardly to press the cutter wire 8 on the expiring web, at 38, FIG. 6. After the cut, the cutter is brought back to its neutral position to engage in the detent 18.

Figure 7:
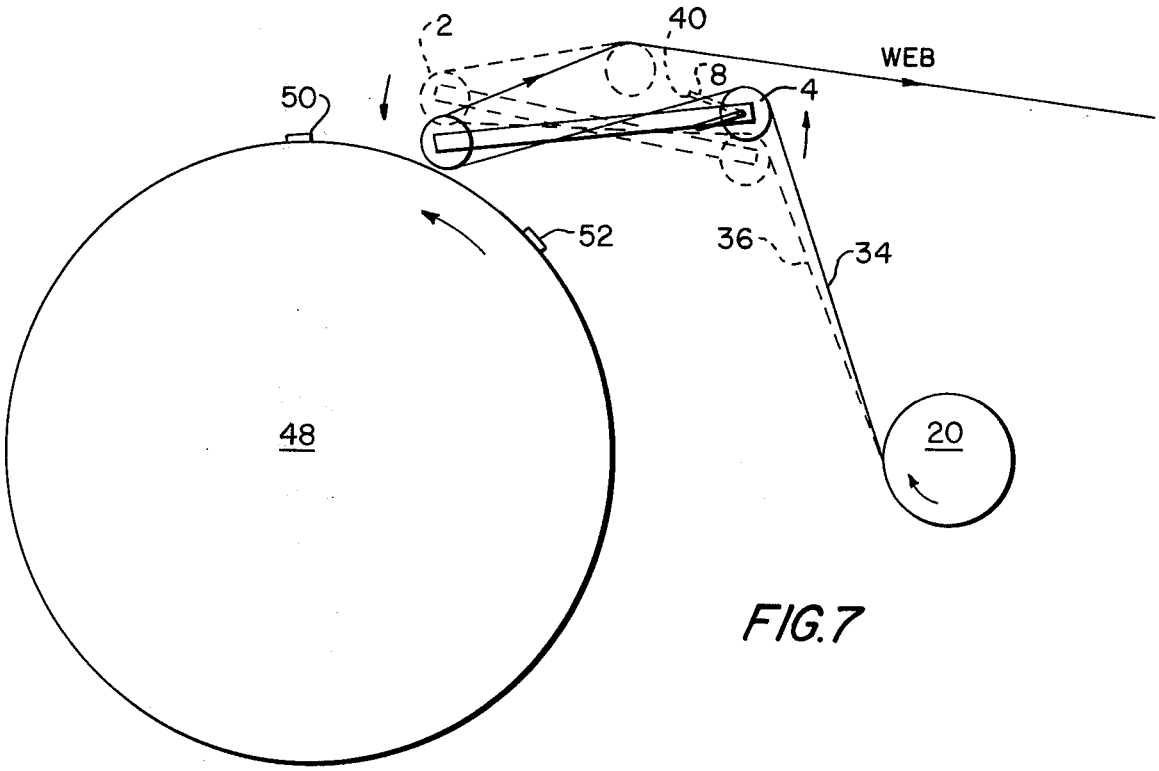
FIG. 7 schematically illustrates the second splicing operation.

After the initial rear positioned roll 22 has expired, a new paper roll, replacing this first expired rear roll, is mounted in a reverse way. The initial clockwise rotation of roll 22 would unwind the newsprint, now anticlockwise rotation of new rear roll 48 will unwind the newsprint. This reverse splice tab 50 for the new rear roll 48 allows it to follow and be pasted to the expiring web 36 from forward roll 20, FIG. 7. Roll preparation is the same as that for the front roll, and splicing procedure is also similar to the first splice, except that the cradle 6 is rotated toward the rear roll so that rear paster roller assembly 2 contacts the expiring web position 34 with the new roll 48 at the rear paper roll position in order to do the pasting; with a trailing splice flag 52. As shown in FIG. 7, cutter 8 is rotated upwardly to press cutting wire up against the secondly expiring web 34 from the front roll.

After the second rear roll 48 expires, the press will be stopped to replace the front roll. Thus, the manual flying paster allows continuous printing from three paper rolls without stopping the press. With some experience, an operator could make splice at speed higher than 5000 pph. Also with skill, expiring web could be cut off right after the pasting to reduce the length of tail.

Figure 8:
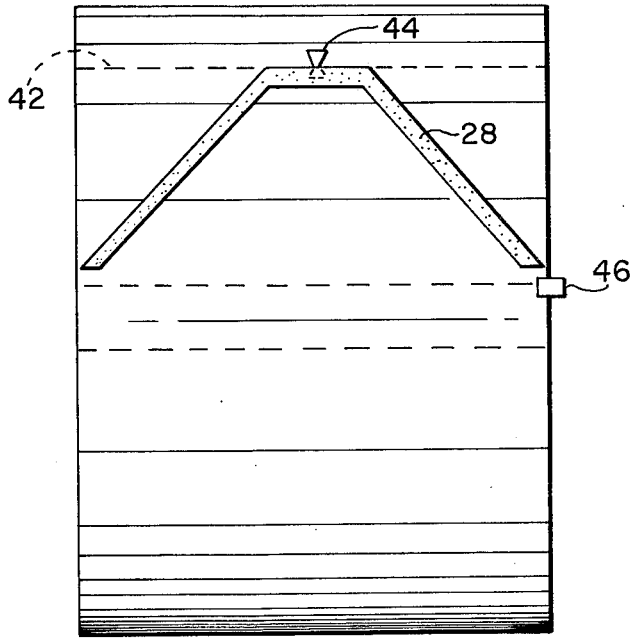
FIG. 8 schematically illustrates splice preparation patterns on a full roll.

Since most splicing malfunctions are caused by poorly prepared rolls, extreme care should be taken in preparation of the new roll. As shown in FIG. 8, the first step in preparing a new roll is to make a clear tear 42 across the roll. To hold this in place, a shear tab 44 is made from a ¼ × 1 inches piece of masking tape which is torn almost in half across its ¼ inch width. The shear tab is placed in the center of the roll, joining the loose web lead to the roll. Adhesive such as 3M Brand No. 465 Adhesive Transfer Tape is applied at 28 to the paper as shown in the FIG. 4. About an 8 inch piece of tape may be applied horizontally across and at the center of the roll, with two longer pieces of tape applied running out at a 45° angle, to within 1 inch of the edge of the roll. Using this tape as a guide, the newsprint outside the tape pattern is torn off. The release backing is then removed from the pressure sensitive tape and the end of the tape pattern 28 may be marked with flag 46 on the operator's side of the roll. When preparation is completed, the roll can be rotated until the splice is in the bottom position, as shown in FIG. 5, and a brake is applied to hold the roll in that position.

While one embodiment of the invention has been shown and described, it is to be understood that certain changes and additions can be made by those skilled in the art without departing from the scope and spirit of this invention which is defined by the appended claims.

I claim:

1. In small printing presses of the type having full paper rolls and press rollers on the same level and including a rollstand for supporting a pair of paper rolls in respective forward and rearward horizontal positions, said rollstand further comprising a frame carrying a horizontally disposed press roller above and between the forward horizontal paper roll position and the rear horizontal paper roll position, the improvement of a manual flying paster which further comprises:

A. a cradle horizontally pivotable about an axis on said rollstand frame, said axis being below said press roller and both above and between full paper rolls at said forward and rear paper roll positions wherein;

B. said cradle further includes a forward and a rear paster roller said forward and rear paster rollers being mounted parallel to said axis and thereby respectively pivotable into contact with a full paper roll in said respective forward and rear paper roll positions; and, C. a trailing web cut-off means comprising a taut wire and means on said cradle for mounting said taut wire for manual pivotal movement about said forward paster roller, said taut wire extending in skewed relation to the plane of said forward and rear paster rollers, said manual flying paster being adapted to initially receive a web from a full paper roll at said rear paper roll position, wherein said web travels forwardly to beneath, and then upwardly around, said forward paster roller, then rearwardly to beneath, and then upwardly around, said rear paster roller, then forwardly and over said existing press roller to subsequent press operations, whereby said trailing web cut-off means around said forward paster roller is operable to cut off a trailing web from an expiring paper roll at either of said forward or rear paper roll positions.

2. The manual flying paster improvement according to claim 1 wherein said cradle includes a handle operable to pivot said cradle between a neutral position to either a first position where said forward paster roller contacts a full paper roll in said forward roll position or a second position where said rear paster roller contacts a full paper roll in said rear paper roll position.

* * * * *